US007021016B2

(12) United States Patent
Steffes et al.

(10) Patent No.: US 7,021,016 B2
(45) Date of Patent: Apr. 4, 2006

(54) ADORNMENT FOR A POST

(75) Inventors: Stephen W. Steffes, McPherson, KS (US); David J. Stucky, Grass Lake, MI (US); Robert D. Shaw, Parma, MI (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 10/796,866

(22) Filed: Mar. 9, 2004

(65) Prior Publication Data

US 2005/0210773 A1 Sep. 29, 2005

(51) Int. Cl.
*E04B 1/00* (2006.01)

(52) U.S. Cl. ..... 52/311.1; 52/301; 52/244; 256/1; 256/22; 256/DIG. 5

(58) Field of Classification Search ..... 256/1, 256/19, 22, 50, 59, 66, DIG. 5; 52/301, 52/311.1, 244; 403/289–290
See application file for complete search history.

(56) References Cited

U.S. PATENT DOCUMENTS

| | | | | |
|---|---|---|---|---|
| 4,216,634 | A * | 8/1980 | Binder | 52/309.9 |
| 4,722,514 | A | 2/1988 | Pettit | |
| 4,912,901 | A * | 4/1990 | Jerry | 52/301 |
| 5,327,694 | A * | 7/1994 | Gamel et al. | 52/721.4 |
| 5,568,709 | A * | 10/1996 | Steckler | 52/309.8 |
| 5,853,167 | A * | 12/1998 | West et al. | 256/66 |
| 6,065,268 | A * | 5/2000 | Gump | 52/737.4 |
| 6,513,284 | B1 * | 2/2003 | Sandlin | 47/66.6 |
| 6,662,515 | B1 | 12/2003 | Buhrts et al. | |
| 6,688,583 | B1 * | 2/2004 | Merrick | 256/1 |
| 6,754,997 | B1 * | 6/2004 | Bonin | 52/220.1 |

* cited by examiner

*Primary Examiner*—Jeanette E. Chapman
(74) *Attorney, Agent, or Firm*—Paul & Paul

(57) ABSTRACT

An adornment for a post is provided, wherein the adornment is any two of a cap adapted to be disposed at the upper end of a post, a base ring adapted to be disposed around a lower end of a post, and a cap ring adapted for disposition around an upper end of the post below and against the cap, as a modular combination of at least two adornment units.

13 Claims, 4 Drawing Sheets

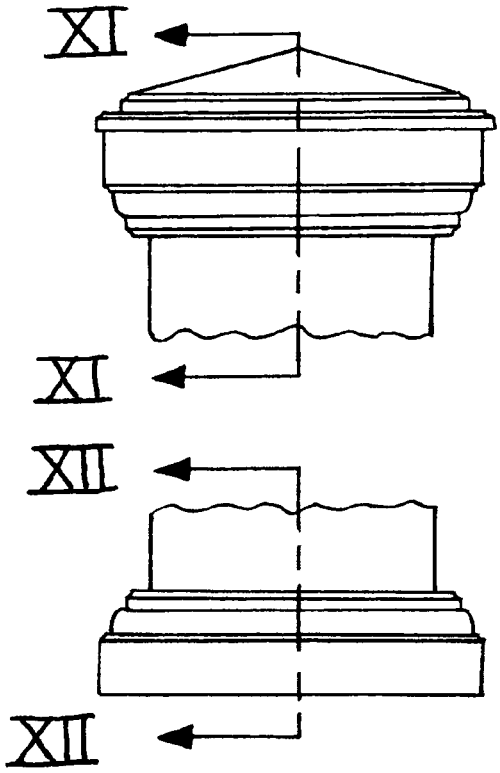
FIG. 10
FIG. 11
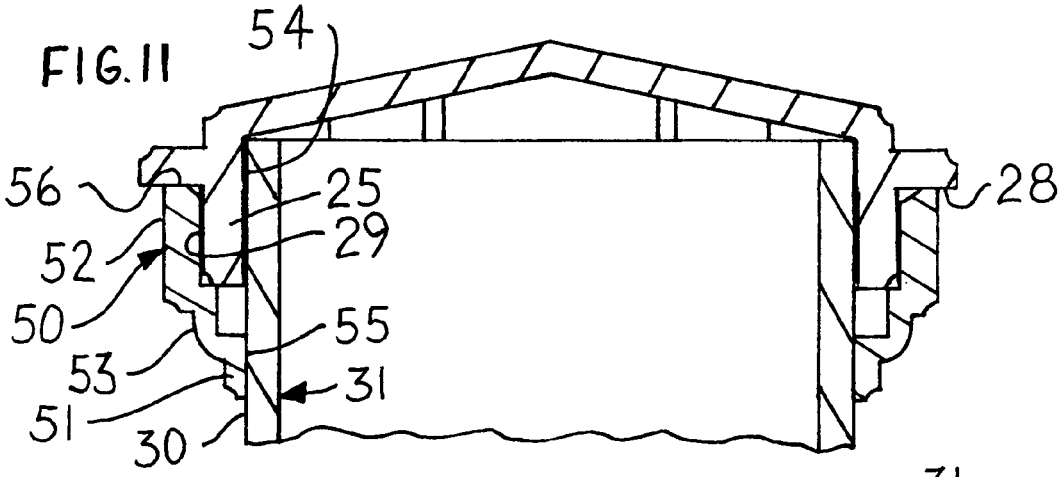
FIG. 12
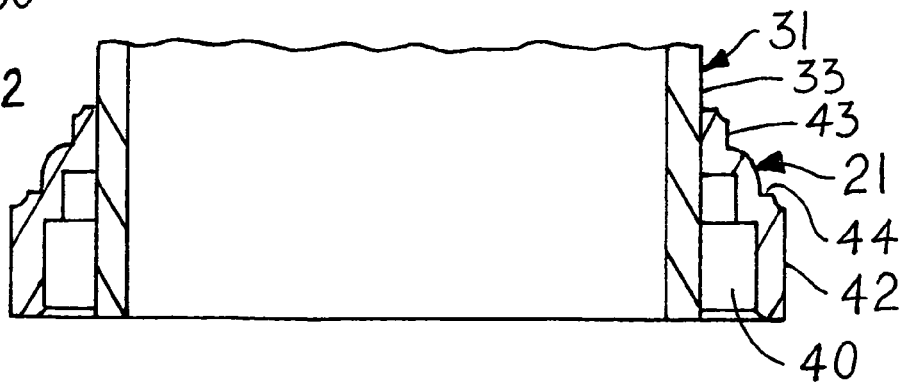

ADORNMENT FOR A POST

BACKGROUND OF THE INVENTION

In the construction of fences, wherein generally vertical posts are used, often anchored in the ground and extending upwardly in a vertical direction, or in other locations where posts are used, such as for supports under porch roofs or the like, it is known to provide adornments for the posts, to provide pleasing aesthetic appearances. Such adornments are often placed around the lower end or base of the post, and or around the upper end or top of the post.

Generally such adornments are constructed in built-up style, by cutting various pieces of molding, often of wooden material, and applying them around the posts, in such a manner as to yield the desired pleasing appearance.

SUMMARY OF INVENTION

The present invention is directed to providing a modular combination comprised of any two of a cap, a base ring and a cap ring, that may be used in different combinations to adorn a post.

It is therefore a primary object of this invention to provide an adornment that is consistent with the summary of the invention, above.

It is another object of this invention to provide an adornment that comprises a cap and a cap ring, wherein the cap has a skirt that fits into a vertical opening through the cap ring, in close fitted engagement relative thereto.

It is another object of the invention to provide a cap ring that is interchangeable in use as a base ring, and the converse thereto.

It is a further object of this invention to provide a cap ring and a base ring that are substantially identically constructed, and which may be applied to opposite ends of a post.

It is another object of this invention to provide an adornment for a post that comprises a cap and a base ring.

It is a further object of this invention to provide an adornment for a post that comprises a cap and each of the base ring and cap ring.

It is yet another object of this invention to accomplish the above objects, wherein whenever a base ring or cap ring is used, the exterior is provided with stepped dimensions that reduce in widthwise dimension from one vertical location along the ring to another vertical location along the ring.

Other objects of this invention include accomplishing the above objects, wherein the adornment can be of molded construction, and comprised of a polymer/wood composite, or a molded plastic material or the like.

Other objects and advantages of the present invention will be readily understood from a brief reading of the following brief descriptions of the drawing figures, the detailed descriptions of the preferred embodiments, and the appended claims.

BRIEF DESCRIPTION OF THE DRAWING FIGURES

FIG. 10 is a view similar to that of FIG.3, but wherein the adornment comprises a cap and a cap ring at the upper end of the post, and a base ring at the lower end of the post.

FIG. 11 is a fragmentary vertical sectional view taken through the cap, cap ring and post of FIG. 10, generally along the line XI—XI of FIG. 10.

FIG. 12 is a fragmentary vertical sectional view, taken through the base ring and post of FIG. 10, generally along the line XII—XII of FIG. 10.

DETAILED DESCRIPTIONS OF THE PREFERRED EMBODIMENTS

Figure 1:
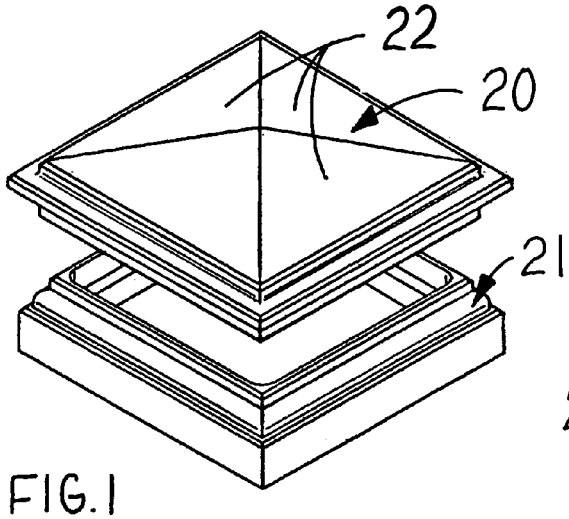
FIG. 1 is a top perspective view of an adornment comprising a cap and base ring in accordance with this invention as an exploded view.
Figure 2:
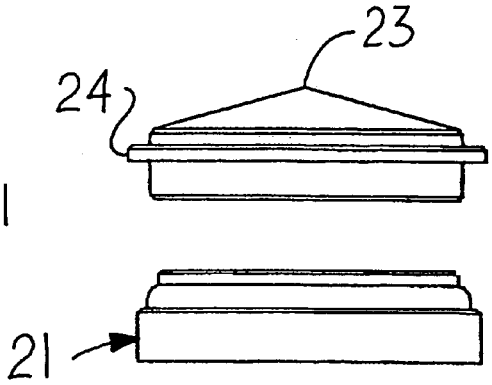
FIG. 2 is a front elevational view of the adornment of FIG. 1.
Figure 3:
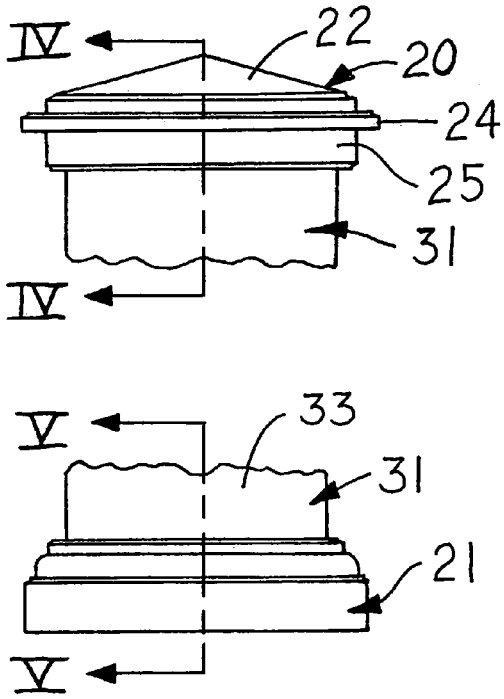
FIG. 3 is a front elevational of the adornment of FIG. 2, applied to upper and lower ends of a generally vertical post, with the post being shown broken away to be foreshortened, as a drafting expedient.
Figure 4:
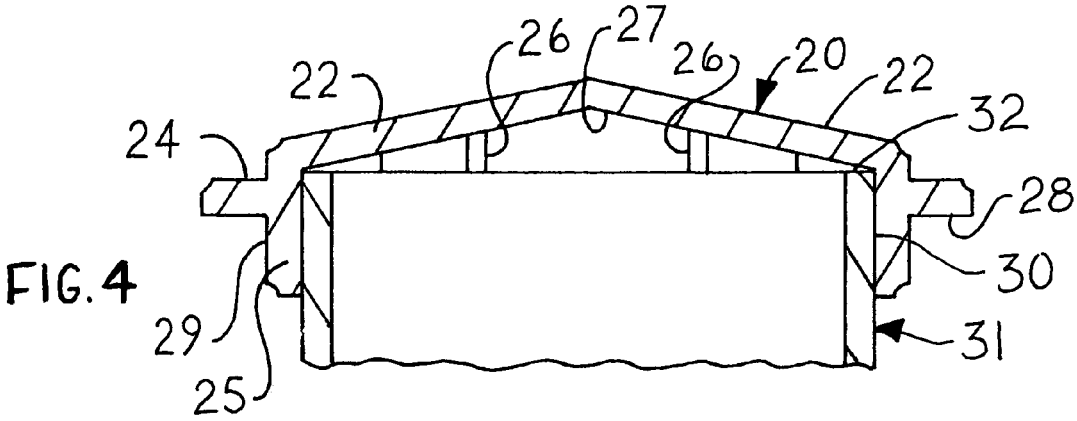
FIG. 4 is a fragmentary vertical sectional view, taken through the upper end of the post and the cap of the adornment of FIG. 3, generally along the line IV—IV of FIG. 3.

Referring now to the drawings in detail, reference is first made to FIG. 1, wherein there are shown in exploded view perspective illustration, a cap 20 for a post, and a base ring 21 for the post. Each of the cap and base ring are generally of rectangular construction, as shown. The cap 20 has a generally transverse portion comprised of four triangular zones 22, arranged as shown in FIG. 1, to meet at a peak 23. With reference to FIGS. 2 and 4, it will be seen that the cap 20 is provided with a rectangular flange 24 extending outwardly from the four sides of the cap 20, as shown, and a depending skirt 25, that likewise exists on all four sides of the cap, as shown. The skirt 25 is adapted to fit snugly, in close engagement over the outside of the upper end 30 of a upstanding post 31, as shown in FIG. 4.

A plurality of optional stand-offs 26 are provided extending downwardly beneath the lower surface 27 of the cap, close to the walls of the skirt 25 and close to the junctions of adjacent triangular zones 22, which engage against the upper end 32 of the post, as shown in FIG. 4.

With reference now to FIGS. 1–3 and 5, it will be seen that the post 31 is provided with a base ring 21, engaging the lower end 33 of the post 31, spaced vertically below the cap 20. The base ring has a hollow interior 40, with a vertical opening extending therethrough, which opening 41 is sized to fit over the lower end 33 of the post 31 in close fitting engagement, or snugly relative thereto. The base ring 21 is comprised of a generally vertical flange portion 42 at its lower end, an upper flange portion 43, and a connecting arcuate portion 44, all of which extend around all four sides of the ring 21, to snugly and correspondingly engage all four sides of the lower end of the post 31.

Figure 5:
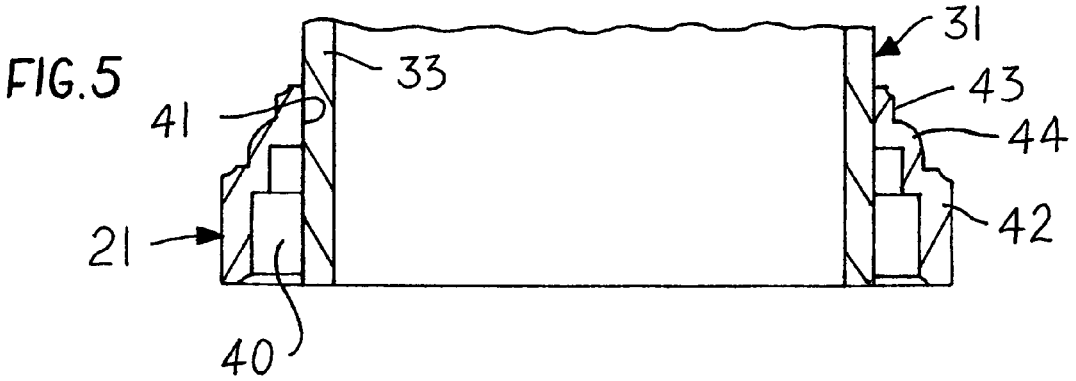
FIG. 5 is a fragmentary vertical section view, taken through the base ring and post of FIG. 3, generally along the line V—V of FIG. 3.
Figure 6:
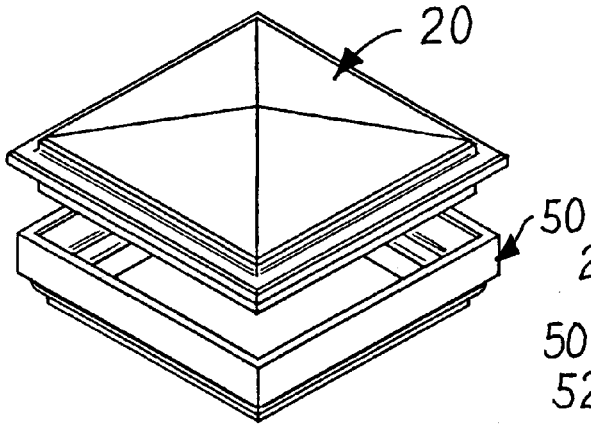
FIG. 6 is a top perspective view of the adornment of this invention, wherein a cap and cap ring are illustrated, as an exploded view.
Figure 7:
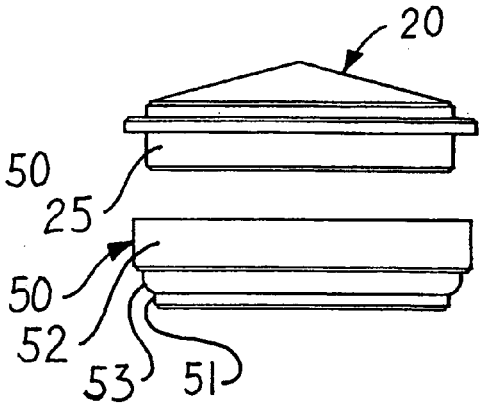
FIG. 7 is front elevational of the adornment of FIG. 6.
Figure 8:
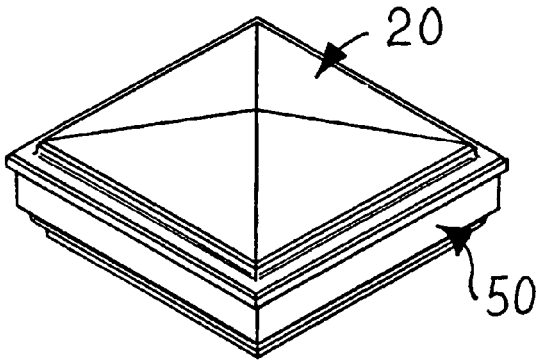
FIG. 8 is a top perspective view of the adornment of FIG. 6, wherein the cap has its skirt fitted into the hollow interior of the cap ring of FIG. 6.
Figure 9:
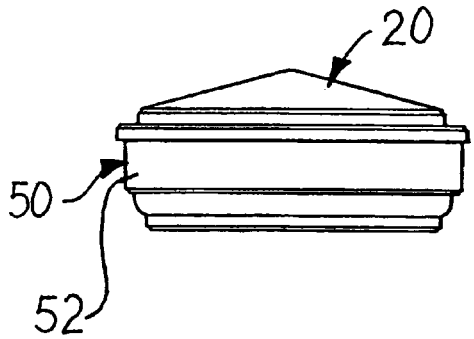
FIG. 9 is a front elevational view of the adornment of FIG. 8.

With reference to FIG. 6, it will be seen that a cap ring 50 is provided, illustrated in exploded perspective view, with the same cap 20 and cap ring 50 being also illustrated in elevational view in FIG. 7. The cap as shown in FIGS. 6 through 12 is the same as that described above with respect to FIGS. 1–4, so the same will not be repeated in detail herein. Similarly, the base ring 21 as shown in FIGS. 10 and 12 is constructed in the same manner as that set forth above for the base ring 21 as described with reference to FIGS. 1–3 and 5, so such description will not again be repeated herein.

With reference now to FIGS. 6–11, the cap ring 50 will be understood as comprising four equidistant sides, similar in that respect to the cap 20 and the base ring 21.

However, the cap ring 50 has a lower vertical portion 51, an upper vertical portion 52, and a connecting arcuate portion 53, as shown in FIG. 11. The upper vertical portion 52 has an interior surface 54 that is sized to engage the exterior surface 29 of the depending skirt 25 of the cap 20, in a snug fitting engagement. Similarly, the interior surface 55 of the depending skirt portion 51 of the cap ring 50 is adapted to engage against the upper outer surface of the post 31, as shown in FIG. 11, likewise in snug fitting engagement.

The stand-offs 26 as shown in FIG. 11 operate in the same manner as they do in the illustration of FIG. 4.

The upper surfaces 56 of the upstanding flange portion 52 of the cap ring 50 engage against the lower surface 28 of the flange of the cap 20, as shown in FIG. 11.

The base ring 21 as shown in FIG. 12 engages the lower end 33 of the post 31 in the same manner as shown in FIG. 5.

It will thus be seen that the cap 20 can be used to engage the upper end 30 of a vertically disposed post 31, with or without the cap ring 50. The base ring 21 may likewise be used at the lower end 33 of a generally vertically disposed post 31, with only a cap 20 at the upper end of the post 31, or with both the cap 20 and cap ring 50 used at the upper end of the post, providing versatility in the design for the adornment for a post, as described.

It will also be understood that while the base ring and cap ring are described as being each a "ring", it will be understood that the "ring" is used in its broadest sense, to accommodate various geometric configurations, which could range from rectangular configurations as shown, to circular configurations, or any of various other shapes when viewed in plan view, to accommodate the configuration of a complementally configured upper and lower ends of a post. It will also be understood that various other modifications may be made in the details of construction of the cap, the base ring, the cap ring, or any of them, all within the spirit and scope of the invention as defined in the appended claims.

What is claimed is:

1. An adornment for a post, comprising:

(a) a cap having a decorative upper end of a predetermined configuration and a lower end; the lower end comprising a downwardly opening hollow skirt having an interior surface and an exterior surface, with the skirt being adapted to be disposed over the top of a post, to receive the post therein, with the interior surface of the skirt in snug fitting close engagement relative thereto;

(b) a ring adapted for disposition around an end of a post, below the cap; with the ring having a hollow interior and having a vertical opening therethrough, sized to fit over the post in close fitting engagement relative thereto; and (c) the ring having a skirt sized to be spaced outwardly of an end of the post, away from the post; the ring skirt having an interior surface sized to engage the exterior surface of the skirt of the cap in snug fitting close engagement therewith.

2. The adornment of claim 1, wherein the ring is interchangeably usable as any of a cap ring and a base ring.

3. The adornment of claim 1, wherein the cap has an outwardly extending flange.

4. The adornment of claim 1, wherein both a base ring and cap ring are provided, constructed to be substantially identical to each other.

5. The adornment of claim 2, wherein a base ring is provided and the exterior surface of the base ring has an exterior of various widthwise stepped dimensions vertically along said exterior surface.

6. The adornment of claim 2, wherein a cap ring is provided and the exterior surface of the cap ring has an exterior of various widthwise stepped dimensions vertically along said exterior surface.

7. The adornment of claim 5, wherein said base ring has stepped exterior dimensions that reduce in widthwise dimension from bottom to top when placed on a post.

8. The adornment of claim 6, wherein said cap ring has stepped exterior dimension that reduce in widthwise dimension from top to bottom when placed on a post.

9. The adornment of any one of claims 1–8, wherein both said base ring and cap ring are provided, adapted to be mounted spaced-apart along a post.

10. The adornment of claim 4, wherein both wherein the exterior surface of the base ring has an exterior of various widthwise stepped dimensions vertically along said exterior surface, wherein the exterior surface of the cap ring has an exterior of various widthwise stepped dimensions vertically along said exterior surface, wherein said base ring has stepped exterior dimensions that reduce in widthwise dimension from bottom to top when placed on a post, wherein said cap ring has stepped exterior dimension that reduce in widthwise dimension from top to bottom when placed on a post, wherein said base ring and cap ring are adapted to be mounted spaced-apart along a post.

11. The adornment of any one of claims 1–4 and 5–8 and 11, wherein the adornment is constructed of a polymer/wood composite.

12. The adornment of any one of claims 1–4 and 5–8 and 11, wherein the adornment is constructed of a molded plastic material.

13. The adornment of claim 1, wherein the interior of the skirt of the cap, and the ring are of rectangular configuration in horizontal cross-section.

* * * * *